US005341578A

United States Patent [19]

Anderson

[11] Patent Number: 5,341,578

[45] Date of Patent: Aug. 30, 1994

[54] BLOWER DRYER PULSED AIRFLOW GENERATING MECHANISM

[75] Inventor: Donald D. Anderson, Colorado Springs, Colo.

[73] Assignee: J. A. Horn, Colorado Springs, Colo. ; a part interest

[21] Appl. No.: 56,119

[22] Filed: Apr. 30, 1993

[51] Int. Cl.[5] ..... A45D 20/00

[52] U.S. Cl. ..... 34/97; 239/581.1; 392/379

[58] Field of Search ..... 34/97, 99; 392/380, 392/397, 379, 383; 416/175, 6, 120, 124, 95, 171; 239/455, 456, 581.1, 581.2, 581

[56] References Cited

U.S. PATENT DOCUMENTS

| | | | |
|---|---|---|---|
| 4,295,283 | 10/1981 | Tomaro | 34/97 |
| 5,054,211 | 10/1991 | Shulman | 34/97 |
| 5,121,463 | 6/1992 | Yoshihara | 392/379 |
| 5,157,757 | 10/1992 | McDougall | 392/383 |
| 5,161,317 | 11/1992 | McDougall | 34/97 |

*Primary Examiner*—Henry A. Bennet
*Attorney, Agent, or Firm*—John R. Flanagan

[57] ABSTRACT

A pulsed airflow generating mechanism for a blower dryer includes an elongated shaft, a stationary disc, a housing, and a spinning disc. The stationary disc is disposed over the shaft and has at least one port radially spaced from the shaft. The housing defines an elongated passageway for guiding a constant airflow therethrough. The housing rotatably mounts the shaft and stationarily mounts the disc relative to the shaft. The spinning disc is disposed over and connected to the shaft for rotation therewith relative to housing and the stationary disc. The spinning disc is located upstream of the stationary disc relative to the direction of airflow. The spinning disc has at least one aperture radially spaced from the shaft for moving intermittently into and out of registry with the port of the stationary disc to convert the constant airflow received by housing passageway into a pulsating airflow discharged from the housing passageway as the spinning disc is rotated relative to the stationary disc.

18 Claims, 1 Drawing Sheet

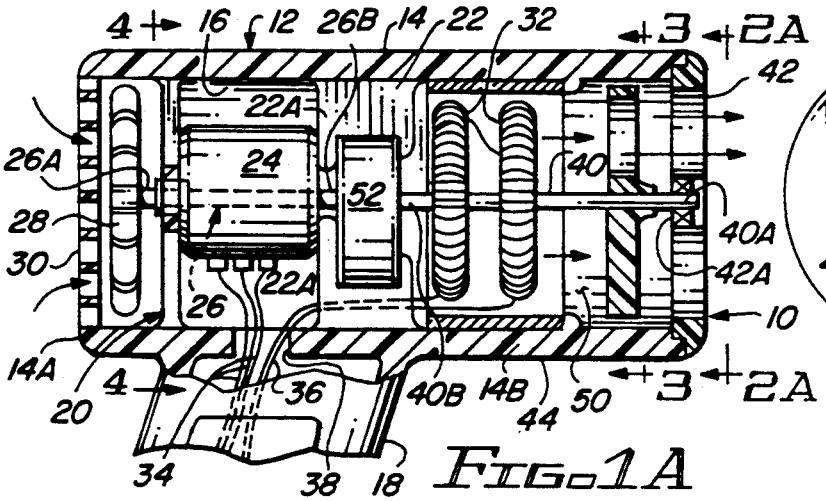
FIG. 1A
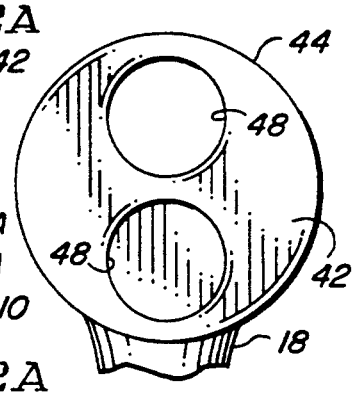
FIG. 2A
FIG. 3
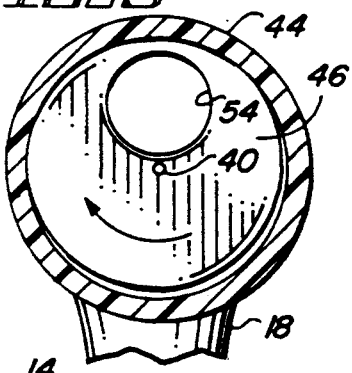
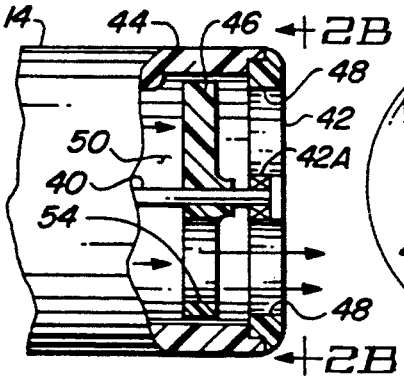
FIG. 1B
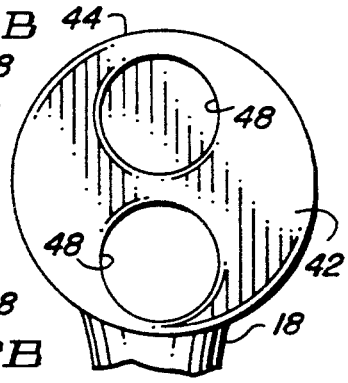
FIG. 2B
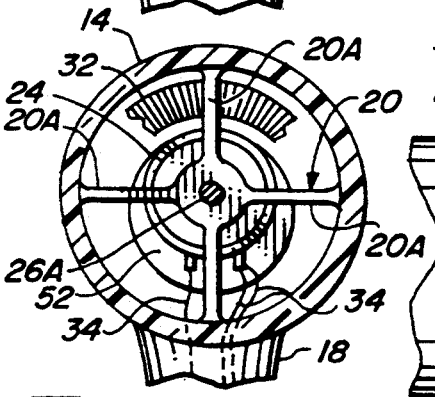
FIG. 4
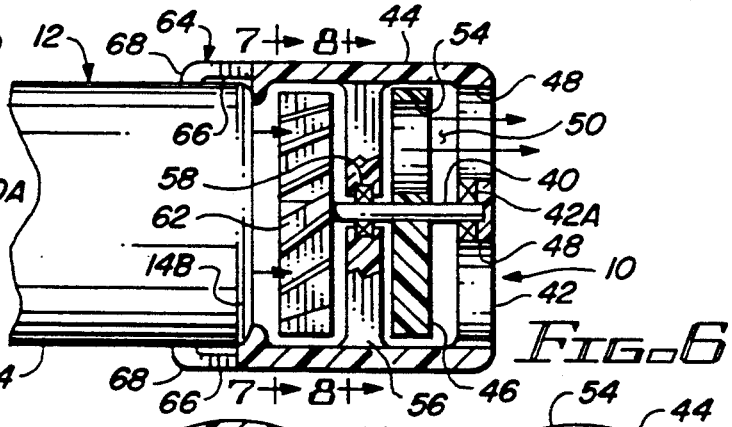
FIG. 6
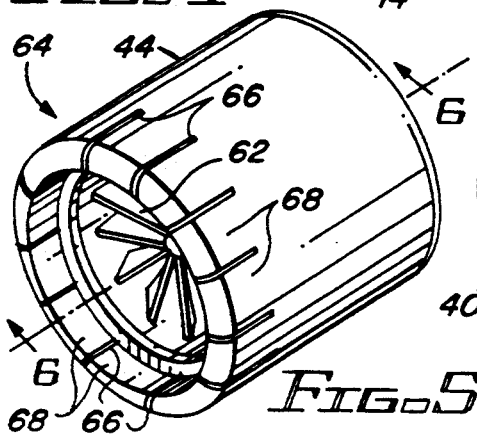
FIG. 5
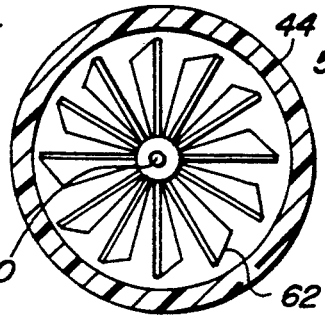
FIG. 7
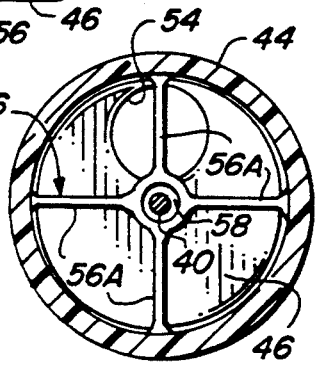
FIG. 8

BLOWER DRYER PULSED AIRFLOW GENERATING MECHANISM

BACKGROUND OF THE INVENTION

1. Field of the Invention

The present invention generally relates to blower dryer operation and, more particularly, is concerned with a pulsed airflow generating mechanism for a blower dryer.

2. Description of the Prior Art

When drying one's hair with a conventional blower dryer, the force of a constant airflow generated by the blower dryer can cause deleterious effects to the hair. Specifically, the constant airflow can cause the hair to mat. Further, the concentration of constant airflow on one region of the hair can cause overheating of the area of impingement and damage to the hair. Also, in the case of hair curls, the constant airflow can cause straighening of the curls, disturbing their setting.

Various proposals of designs for modifying the constant airflow to reduce the above-noted deleterious effects on one's hair appear in the prior patent art. Representative examples of such proposed designs are the ones discloses in U.S. Pat. Nos. to Tomaro (4,295,283), Shulman (5,054,211), Yoshihara (5,121,463) and McDougall (5,157,757). Of these proposed designs, only the design of the Yoshihara patent, which produces an intermittent pulse-like flow, instead of a uniform constant flow, appears to be a step in the right direction for reducing the above-noted undesirable effects. However, the hot air pulse generator of the Yoshihara patent employs a complicated arrangement of a baffle and butterfly valve to achieve the pulsed airflow which appears to be an unsatisfactory solution to the aforementioned problem. Thus, a need still exists for an improved pulsed airflow generator design.

SUMMARY OF THE INVENTION

The present invention provides a pulsed airflow generating mechanism for a blower dryer which is designed to satisfy the aforementioned need. The pulsed airflow generating mechanism of the present invention delivers high speed puffs of air which produces constant movement of the hair and results in faster hair drying and thus shorter drying time. The shorter period of time spent in drying the hair, in turn, results in lower energy usage and less damage to the hair.

Accordingly, the present invention is directed to a pulsed airflow generating mechanism which comprises: (a) an elongated shaft; (b) a stationary disc disposed over the shaft and having at least one port radially spaced from the shaft; (c) a housing defining an elongated passageway for guiding a constant airflow therethrough, the housing rotatably mounting the shaft and stationarily mounting the disc relative to the shaft; and (d) a spinning disc disposed over and connected to the shaft for rotation therewith relative to the housing and the stationary disc, the spinning disc having at least one aperture radially spaced from the shaft for moving intermittently into and out of registry with the port of the stationary disc to thereby convert the constant airflow received into the housing to a pulsating airflow discharged from the housing as the spinning disc is rotated relative to the stationary disc.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1A is a longitudinal sectional view of a first embodiment of a pulsed airflow generating mechanism of the present invention incorporated in the housing of a blower dryer with a spinning disc of the mechanism being shown in a twelve o'clock rotational position.

FIG. 1B is a fragmentary sectional view of the mechanism of FIG. 1A with the spinning disc of the mechanism being shown in a six o'clock rotational position.

FIG. 2A is a front elevational view of a stationary disc of the mechanism as seen along line 2A—2A of FIG. 1A.

FIG. 2B is a front elevational view of the stationary disc of the mechanism as seen along line 2B—2B of FIG. 1B.

FIG. 3 is a cross-sectional view taken along line 3—3 of FIG. 1A.

FIG. 4 is another cross-sectional view taken along line 4—4 of FIG. 1A.

FIG. 5 is a perspective view of a second embodiment of a pulsed airflow generating mechanism of the present invention provided as an attachment to the front end of the housing of the blower dryer.

FIG. 6 is a longitudinal sectional view of the pulsed airflow generating mechanism attachment of FIG. 5 mounted to the front end of the blower dryer housing.

FIG. 7 is a cross-sectional view taken along line 7—7 of FIG. 6.

FIG. 8 is another cross-sectional view taken along line 8—8 of FIG. 6.

DETAILED DESCRIPTION OF THE INVENTION

Referring to the drawings and particularly to FIGS. 1A, 1B, 2A, 2B, 3 and 4, there is illustrated a first embodiment of a pulsed airflow generating mechanism of the present invention, generally designated 10, being incorporated as part of a blower dryer 12. The blower dryer 12 includes a tubular hollow housing 14 defining an elongated passageway 16 and having a rear inlet opening 14A and a front outlet opening 14B spaced apart and defined at opposite ends of the passageway 16, and a handle 18 integrally fixed to the housing 14 near the inlet opening 14A thereof. The handle 18 is to be employed by a user to grip and hold the blower dryer 12 in order to point an airflow generated by the blower dryer 12 in a desired direction.

The blower dryer 12 also includes a pair of axially spaced support webs 20, 22 having a plurality of circumferentially spaced radially extending arms 20A, 22A fixed across the passageway 16 of the housing 14 and rigidly connected therewith, and an electric drive motor 24 disposed in the passageway 16 of the housing 13 and supported between the webs 20 22. The drive motor 24 has a central rotatable drive shaft 26 with opposite rear and front end portions 26A, 26B extending in opposite directions from the motor 24. The blower dryer 12 further includes an air generating impeller 28 disposed in the passageway 16 of the housing 14 over and secured to the rear end portion 26A of the drive shaft 26 of the drive motor 24. The impeller 28 is located between the drive motor 24 and a perforated disk 30 stationarily mounted across the rear inlet opening 14A of the housing 14. Operation of the drive motor 24 rotatably drives the impeller 28 to generate a constant airflow through the housing passageway 16 from the rear inlet opening 14A to the front outlet opening 14B thereof.

Still further, the blower dryer 12 typically includes a pair of axially spaced annular heating coils 32 disposed in passageway 16 of the housing 14 between the drive motor 24 and the front outlet opening 14B of the housing 14. A plurality of electrical conductors 34, 36 are electrically connected to suitable controls (not shown) mounted in the handle 18 and extend through an opening 38 between the interior of the handle 18 and the passageway 16 of the housing 14. The electrical conductors 34, 36 respectively electrically connect with the drive motor 24 and the heating coils 32.

As shown in FIGS. 1A, lB, 2A, 2B, 3 and 4, the first embodiment of the pulsed airflow generating mechanism 10 is incorporated as a permanent part of the blower dryer 12. Basically, the first embodiment of the generating mechanism 10 includes an elongated extension shaft 40, a stationary disc 42, a housing extension 44, and a spinning disc 46. The stationary disc 42 is disposed over the extension shaft 40 and has at least one and preferably two or more ports 48 defined therethrough radially spaced from the extension shaft 40 and in circumferentially spaced relation to one another. The housing extension 44, being an integral part of the housing 14, also defines an elongated extension 50 of the passageway 16 for continued guiding of the airflow therethrough. The stationary disc 42 is secured in the forward end 44A of the housing extension 44 and extends across the forward outlet 14B of the overall housing 14. The stationary disc 42 includes a central bearing 42A which rotatably supports a forward end 40A of the extension shaft 40.

The generating mechanism 10 can also include a speed reducing gear box 52 disposed in the passageway 16 of the housing 14. The gear box 52 is supported by the front support web 22 and disposed between the drive motor 24 and the extension shaft 40. The gear box 52 is drivingly connected to the front end portion 26B of the motor drive shaft 26 and to a rear end 40B of the extension shaft 40. Thus, the housing 14 and its extension 44 rotatably mount the extension shaft 40 via the stationarily mounted gear box 52 and the stationary disc 42.

The spinning disc 46 is disposed over and connected to the extension shaft 40 for rotation therewith relative to housing 14 and the stationary disc 42. The spinning disc 46 is located upstream of the stationary disc 42 relative to the direction of airflow. The spinning disc 46 has at least one aperture 54 defined therethrough being radially spaced from the extension shaft 40. Preferably, the stationary and spinning discs 42, 46 are circular in shape as are the respective ports 48 and aperture 54 thereof.

As seen in FIGS. 1A, lB, 2A, 2B and 3, the aperture 54 moves intermittently into and out of registry with the ports 48 of the stationary disc 42, as the spinning disc 46 is rotated relative to the stationary disc 42, to thereby convert the constant airflow created through housing passageway 16 and passageway extension 50 by the rear impeller 28 into a pulsating airflow discharged from the housing passageway extension 50 through the front outlet 14B. The rate of the pulses of airflow depends on the number of ports 48 provided in the stationary disc 42 and the rotational speed of the spinning disc 46.

Referring to FIGS. 5, 6, 7 and 8, there is illustrated a second embodiment of the pulsed airflow generating mechanism 12 of the present invention being provided as a removable attachment at the front end 14B of the housing 14 of the blower dryer 12. The second embodiment of the generating mechanism 10 basically includes the elongated extension shaft 40, stationary disc 42, housing extension 44, and spinning disc 46, as described above with respect to the first embodiment of the generating mechanism 10.

The second embodiment of the generating mechanism 10 also includes a middle support web 56 having a plurality of circumferentially spaced radially extending arms 56A fixed across the passageway extension 50 of the housing extension 44 and rigidly connected therewith. The middle support web 56 also has a bearing 58 mounted in a central opening 60 of the support web 56 which, along with the stationary disc 42, rotatably supports the extension shaft 40. The middle support web 56 is preferably disposed upstream of the spinning disc 46 relative to the direction of airflow through the passageway extension 50.

The second embodiment of the generating mechanism 10 also includes an auxiliary impeller 62 secured on the rear end 40B of the extension shaft 40. In this embodiment the rear end of the extension shaft 40 is not coupled to the drive motor 24. Instead the constant airflow generated by the primary impeller 28 is employed to rotatable drive the auxiliary impeller 62 which, in turn, rotates the extension shaft 40 and spinning disc 46 secured thereon. The rear end 44B of the housing extension 44 has gripping means 64 in the form of a plurality of circumferentially spaced parallel slots 66 formed therein which defines deformable segments 68 about the rear end 44B between the slots 66. The material of the housing extension 44 is sufficiently semi-flexible to permit the segments 68 to flex sufficiently to permit expansion of the size of the rear end 44B to allow the housing extension 44 to be releasably inserted and attached over the front end 14B of the housing 14. Of course, a different feature can be provided for attaching the pulsed airflow generating mechanism 10 to the blower dryer 12 than the one illustrated in FIGS. 5 and 6.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A pulsed airflow generating mechanism, comprising:

(a) an elongated shaft;

(b) a stationary disc disposed over said shaft and having at least one port radially spaced from said shaft;

(c) a housing defining an elongated passageway for guiding a substantially constant airflow therethrough in a predetermined direction, said housing rotatably mounting said shaft and stationarily mounting said stationary disc relative to said shaft;

(d) a spinning disc disposed over and connected to said shaft for rotation therewith relative to said housing and to said stationary disc, said spinning disc being located upstream of said stationary disc relative to the direction of airflow, said spinning disc having at least one aperture radially spaced from said shaft for moving intermittently into and out of registry with said port of said stationary disc to convert the constant airflow received by said housing passageway into a pulsating airflow discharged from said housing passageway as said spinning disc is rotated relative to said stationary disc; and (e) an impeller disposed in said housing passageway, located upstream of said spinning disc and stationary disc relative to the direction of airflow, and secured on said shaft for causing rotation of said shaft in response to receiving the constant airflow through said housing passageway.

2. The mechanism of claim 1 wherein at least a pair of said ports are defined in said stationary disc.

3. The mechanism of claim 1 wherein said stationary disc rotatably supports a forward end of said shaft.

4. A pulsed airflow generating mechanism comprising:

(a) an elongated shaft;

(b) a stationary disc disposed over said shaft and having at least one port radially spaced from said shaft;

(c) a housing defining an elongated passageway for guiding a substantially constant airflow therethrough in a predetermined direction, said housing rotatably mounting said shaft and stationarily mounting said stationary disc relative to said shaft; and (d) a spinning disc disposed over and connected to said shaft for rotation therewith relative to said housing and to said stationary disc, said spinning disc being located upstream of said stationary disc relative to the direction of airflow, said spinning disc having at least one aperture radially spaced from said shaft for moving intermittently into and out of registry with said port of said stationary disc to convert the constant airflow received by said housing passageway into a pulsating airflow discharged from said housing passageway as said spinning disc is rotated relative to said stationary disc;

(e) said stationary and spinning discs being circular in shape and said respective ports and aperture thereof being circular in shape.

5. The mechanism of claim 4 further comprising:

an impeller disposed in said housing passageway and secured on a rear end of said shaft for causing rotation of said shaft in response to receiving the constant airflow through said housing passageway.

6. A pulsed airflow generating blower dryer apparatus, comprising:

(a) a blower dryer including (i) a tubular hollow housing defining an elongated passageway and having a rear inlet opening and a front outlet opening spaced apart and defined at opposite ends of the passageway, (ii) an electric drive motor supported in said passageway of said housing, and (iii) an airflow generating impeller rotatably supported in said passageway of said housing and coupled to said drive motor such that operation of said drive motor rotatably drives said impeller to generate a constant airflow through said housing passageway from said rear inlet opening to said front outlet opening thereof; and (b) a pulsating airflow generating mechanism including (i) an elongated shaft drivingly coupled to said drive motor, (ii) a stationary disc disposed over said shaft and having at least one port radially spaced from said shaft, (iii) a housing extension connected to said housing of said blower dryer and extending forwardly therefrom and defining an elongated passageway extension communicating with said passageway of said housing for guiding the constant airflow generated by said impeller therethrough in a forward direction, said housing extension rotatably mounting said shaft and stationarily mounting said disc relative to said shaft, and (iv) a spinning disc disposed over and connected to said shaft extension for rotation therewith relative to said housing extension and said stationary disc, said spinning disc being located upstream of said stationary disc relative to the forward direction of airflow, said spinning disc having at least one aperture radially spaced from said shaft extension for moving intermittently into and out of registry with said port of said stationary disc to convert the constant airflow received by said housing passageway extension into a pulsating airflow discharged from said housing passageway extension as said spinning disc is rotated relative to said stationary disc.

7. The apparatus of claim 6 wherein at least a pair of said ports are defined in said stationary disc.

8. The apparatus of claim 6 wherein said stationary disc rotatably supports a forward end of said shaft extension.

9. The apparatus of claim 6 wherein said stationary and spinning discs are circular in shape and said respective ports and aperture thereof are circular in shape.

10. The apparatus of claim 6 wherein said pulsating airflow generating mechanism also includes a speed reducing means disposed in said passageway of said housing between and drivingly interconnecting said drive motor.and shaft extension.

11. A pulsed airflow generating blower dryer attachment, comprising:

(a) an elongated shaft;

(b) a stationary disc disposed over said shaft and having at least one port radially spaced from said shaft;

(c) a housing defining an elongated passageway for guiding a substantially constant airflow therethrough in a predetermined direction, said housing rotatably mounting said shaft and stationarily mounting said disc relative to said shaft, said housing having gripping means defined about a rear end of said housing being capable of releasable attachment to a front end of a housing of a blower dryer; and (d) a spinning disc disposed over and connected to said shaft for rotation therewith relative to said housing and said stationary disc, said spinning disc being located upstream of said stationary disc relative to the direction of airflow, said spinning disc having at least one aperture radially spaced from said shaft for moving intermittently into and out of registry with said port of said stationary disc to convert the constant airflow received by said housing passageway into a pulsating airflow discharged from said housing passageway as said spinning disc is rotated relative to said stationary disc.

12. The attachment of claim 11 wherein said gripping means includes a plurality of circumferentially spaced parallel slots formed in said rear end of said housing so as to define deformable segments on said housing between said slots being sufficiently flexible to permit expansion of the size of said rear end to allow said housing to be releasably inserted and attached over the front end of the blower dryer housing.

13. The attachment of claim 11 wherein at least a pair of said ports are defined in said stationary disc.

14. The mechanism of claim 11 wherein said stationary disc rotatably supports a forward end of said shaft.

15. The mechanism of claim 11 further comprising:

an impeller disposed in said housing passageway and secured on a rear end of said shaft for causing rotation of said shaft in response to receiving the constant airflow through said housing passageway.

16. The mechanism of claim 11 wherein said stationary and spinning discs are circular in shape and said respective ports and aperture thereof are circular in shape.

17. The mechanism of claim 5 wherein at least a pair of said ports are defined in said stationary disc.

18. The mechanism of claim 5 wherein said stationary disc rotatably supports a forward end of said shaft.

* * * * *